US005629728A

United States Patent [19]

Karita et al.

[11] Patent Number: 5,629,728

[45] Date of Patent: May 13, 1997

[54] INK CONTAINER HAVING ATMOSPHERE COMMUNICATING SECTION AND RECORDING HEAD

[75] Inventors: Seiichiro Karita, Yokohama; Teruo Arashima, Kawasaki, both of Japan

[73] Assignee: Canon Kabushiki Kaisha, Tokyo, Japan

[21] Appl. No.: 356,777

[22] Filed: Dec. 12, 1994

Related U.S. Application Data

[63] Continuation of Ser. No. 911,950, Jul. 10, 1992, abandoned.

[30] Foreign Application Priority Data

Jul. 15, 1991 [JP] Japan ..... 3-173957

[51] Int. Cl.[6] ..... B41J 2/175

[52] U.S. Cl. ..... 347/87; 347/85

[58] Field of Search ..... 347/85, 86, 87

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,463,359 | 7/1984 | Ayata et al. | 346/1.1 |
| 4,723,129 | 2/1988 | Endo et al. | 346/1.1 |
| 4,740,796 | 4/1988 | Endo et al. | 346/1.1 |
| 4,920,362 | 4/1990 | Cowger | 346/140 R |
| 5,182,581 | 1/1993 | Kashimura et al. | 346/140 R |

FOREIGN PATENT DOCUMENTS

| | | |
|---|---|---|
| 0378241 | 7/1990 | European Pat. Off. . |
| 0425254 | 5/1991 | European Pat. Off. . |
| 3811171 | 10/1988 | Germany . |
| 54-56847 | 5/1979 | Japan . |
| 60-71260 | 4/1985 | Japan . |

*Primary Examiner*—Valerie Lund

*Attorney, Agent, or Firm*—Fitzpatrick, Cella, Harper & Scinto

[57] ABSTRACT

An ink container has an atmosphere communicating section for placing the inside of the container in communication with the atmosphere. The atmosphere communicating section has a plurality of chambers, one of which communicates with the inside of the ink container, and another of which communicates with the atmosphere. Each chamber communicates with another chamber through a port smaller than the chamber. Preferably, the plurality of chambers are disposed in a direction intersecting a direction from the interior to the exterior of the ink container and the opening in the chambers are positioned such that they are shifted from each other. This arrangement prevents ink leakage through the atmosphere communicating section and eliminates a general feeling of anxiety on the part of users deriving from the possibility of having their hands and clothes soiled with spilt ink. It also inhibits ink evaporation.

19 Claims, 14 Drawing Sheets

INK CONTAINER HAVING ATMOSPHERE COMMUNICATING SECTION AND RECORDING HEAD

This application is a continuation of application Ser. No. 07/911,950 filed Jul. 10, 1992, now abandoned.

BACKGROUND OF THE INVENTION

1. Field of the Invention

The present invention relates to an ink container for containing recording liquid such as liquid ink or ink in a solid state but liquefied at least at the time of use and applicable to various kinds of recording equipment. More particularly, the present invention relates to an atmosphere communicating construction for making an ink container communicate with the atmosphere or the outside air, with an ink jet recording head for recording by means of droplets and a tank for supplying recording liquid to the recording head which are held as a section, and to what is effectively applicable to such a recording head.

2. Related Background Art

In an ink cartridge incorporating a recording head and an ink container for supplying ink to a recording head cartridge and a recording head which are reciprocally moved on a carriage, the recording head and the ink container have been known to contain a porous material: the former for holding the ink supplied and the latter for containing waste ink. These are normally provided with an atmosphere communicating port for equalizing the atmospheric pressure and the internal pressure of a tank, though there still exist problems of ink leakage and ink rocking. Although attempts have been made to prevent ink from leaking from the port by providing the port with a porous film, such a film is expensive and the provision of the film involves a great deal of not only skill but also cost. Although it may be considered feasible to prevent ink leakage by providing a large-sized atmosphere communicating port, there arises another problem in that the apparatus tends to become large in size.

In some of the high-speed printing machines for full-line printing using large-sized recording heads, there are installed large-sized tanks whose openings to the atmosphere are positively provided with automatic switch valves. However, the provision of such an automatic switch valve tends to make the machine costly.

Unlike an ordinary recording cartridge whose tank simply has an atmosphere communicating port, a tank containing a porous material basically allows recording liquid to be held in the porous material, thus preventing the recording liquid from leaking out of the atmosphere communicating port and a nozzle in normal operation. In case a shock resulting from falling or vibration is applied to the recording cartridge, the recording liquid may scatter in the air as it cannot be held in the porous material any longer. If the droplets thus scattered stick to the atmosphere communicating port, the recording liquid may spring out of the cartridge through the atmosphere communicating port and soil the outer wall.

SUMMARY OF THE INVENTION

The present invention is intended to solve the problems heretofore recognized and newly-imposed technical problems of preventing not only the evaporation of ink but also ink leakage substantially even though ink is miscarried. From a different angle of view, the present invention is also intended to demonstrate a satisfactory ink leakage preventive effect even if a given space is extremely small.

A first object of the present invention is to provide an ink container free from ink leakage against vibration and a shock.

A second object of the present invention is to provide an ink container capable of reducing the evaporation of ink far more effectively than before and solving the problem of an increase in ink viscosity and further to provide a section for sale whose wrapping at a point of sale can be made inexpensive and simple by the container and which is totally constructed less expensively.

A third object of the present invention is to provided an ink container capable of supplying ink for use with stability in case the ink is miscarried or leaks out and simultaneously of recovering the ink into the ink container.

These and other objects of the present invention will become more apparent by reference to the description, taken in connection with the accompanying drawings.

In order to accomplish the objects stated above, an ink container for containing ink has a atmosphere communicating section for making its inside communicate with the outside air, the atmosphere communicating section comprising a plurality of chambers outwardly communicating with each other, and the opening of each chamber is a port relatively smaller than the chamber. As the atmosphere communicating section is provided with the plurality of chambers relatively larger than the openings stepwise via small ports between the inner and outer openings according to the present invention, it is capable of interfering with ink leakage a plurality of times, whereas the ink forcibly entered is not allowed to reach the outside without passing through the ink holding space a plurality of times. Therefore, an excellent ink leakage preventive effect is brought about as compared with the prior art. Moreover, the problem of evaporation is greatly improved as the provision of the plurality of chambers makes it hardly probable for a convection current of air to occur in the container.

In addition, the openings of the respective chambers are characterized in that their positions are shifted from one another, whereby the dispersion effect is produced upon the ink caused to be entered forcibly because of a shock or vibration. Ultimately, the ink leakage preventive effect can thus be achieved efficiently even in a very small space.

On the other hand, the plurality of chambers are positioned in a direction intersecting the inner-to-outer direction, whereby the dispersion effect is similarly produced upon the ink caused to be entered forcibly because of a shock or vibration. With this arrangement, the ink leakage preventive effect can ultimately be demonstrated practically with the advantage of making smaller the atmosphere communicating section. This mechanism, though it is effective all alone, contributes to improving the synergistic effect when applied to the aforementioned construction.

With respect to the relative positions of the chambers, a marked buffer effect is first of all added to the given space by satisfying a relative relationship in that any one of the inner chambers has a greater capacity and this is also effective in preventing ink leakage.

On the other hand, another problem is posed when a member contiguous to the inner wall surface exists near the atmosphere communicating section so that the atmosphere communicating section is arranged in the ink container. In other words, ink may be relayed along the member contiguous to the inner wall surface. Although the aforementioned arrangement ensures that such ink can be stopped to a degree, the reliability of the present invention may be maintained longer without the member above.

Consequently, the end portion of the opening of the ink container should be protruded inwardly from the contiguous member in a preferred embodiment of the present invention. In this case, the end of the opening should preferably be kept in non-contact with a porous material such as an ink absorber.

These features of the present invention will become more apparent as the description proceeds. In any case, the features of the present invention and each embodiment thereof will be demonstrated by each of the independent effects and the synergistic effect deriving from the combinations of these effects.

BRIEF DESCRIPTION OF THE DRAWINGS

FIG. 9A illustrates a three-room construction; FIG. 9B a two-room construction with a planar partition; and FIG. 9C a two-room construction with a curved partition of FIG. 1.

DETAILED DESCRIPTION OF THE PREFERRED EMBODIMENTS

Figure 2:
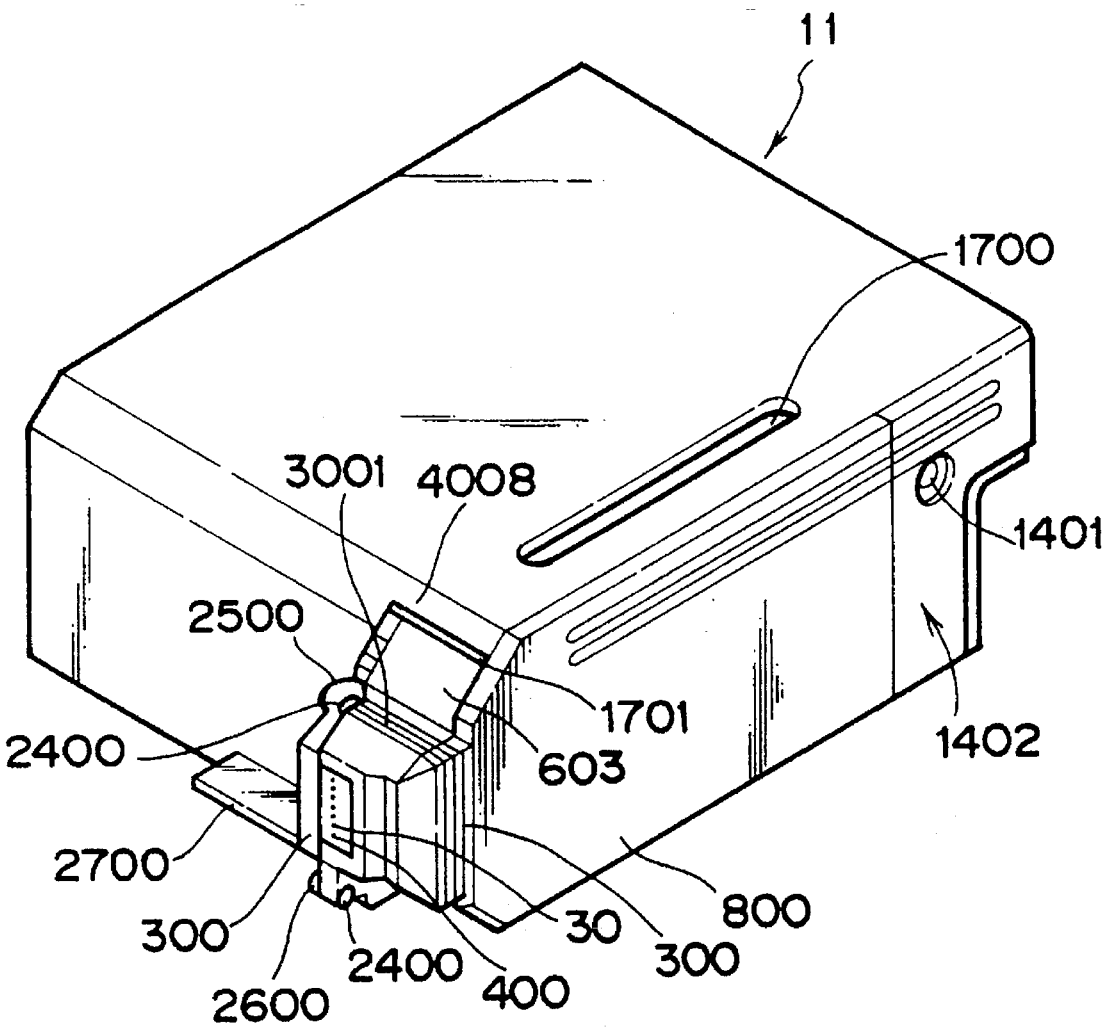
FIG. 2 PRIOR ART
FIG. 2 is a perspective view of an ink jet cartridge for use in an ink jet recording apparatus embodying the present invention.
Figure 3:
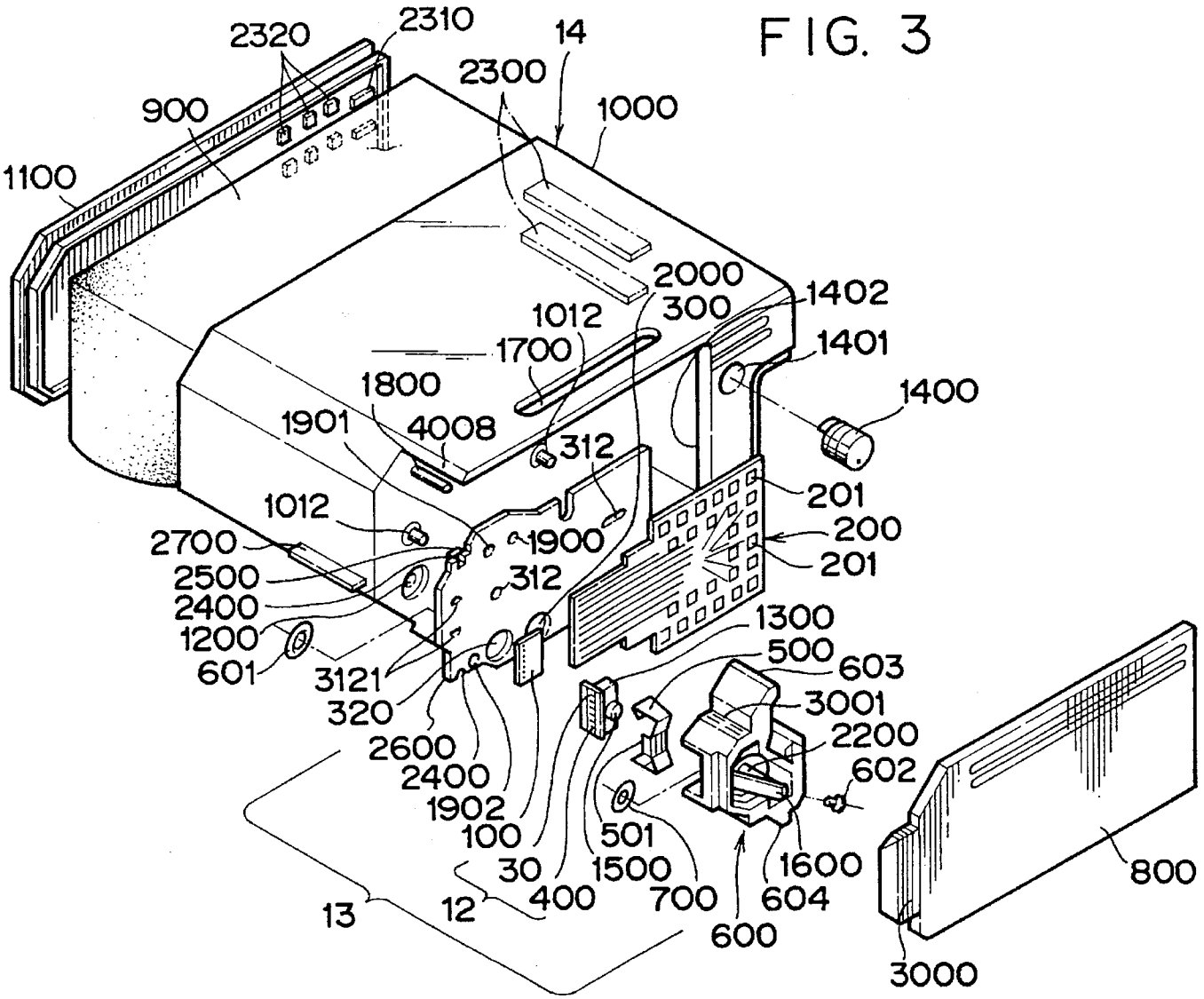
FIG. 3 is an exploded view of the ink jet cartridge, illustrative of a construction incorporating the present invention.

Referring to FIGS. 2 to 7 inclusive, a description will be given of a recording head and a recording apparatus which can incorporate the present invention most suitably, before the principal part of an embodiment of the invention is explained. FIG. 2 is a perspective view of an ink jet cartridge 11 for use in an ink jet recording apparatus that can embody the present invention. FIG. 3 is an exploded view of the ink jet cartridge 11 in reference to its configuration, showing how it can incorporate the present invention. Referring to mainly FIG. 3, the present invention will be described.

The ink jet cartridge 11 comprises an ink jet head 12 equivalent to a recording head having a number of discharge ports 30 formed integrally, an ink jet section 13 including the ink jet head 12 and incorporating electric wiring and ink piping, and an ink tank 14, these being held together as a section. The ink jet cartridge 11 of this embodiment has a capacity of containing more ink than a conventional one and the leading end of the ink jet section 13 is slightly protruded from the front of the ink tank 14. This ink jet cartridge 11 is firmly supported by a positioning means and electric contacts, as will be described later, of a carriage 16 mounted on an ink jet recording apparatus proper 15. The ink jet cartridge 11 is of a disposable type detachable from the carriage 16 (see FIG. 6).

Figure 4:
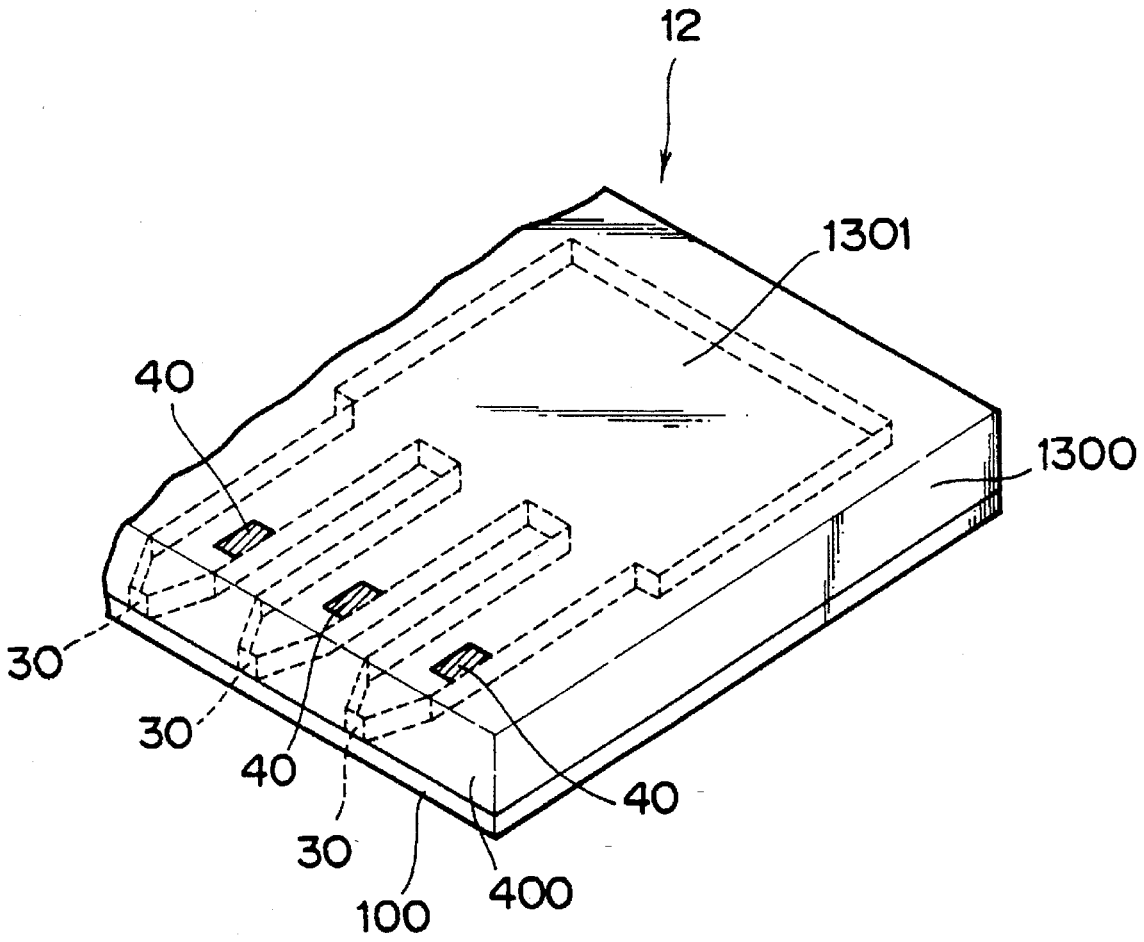
FIG. 4 PRIOR ART
FIG. 4 is a partial perspective view of an ink jet head.

The configuration of the ink jet head 12 will subsequently be described. As shown in FIG. 4, the ink jet head 12 is provided with electrothermal converters 40 to which voltage is applied to generate thermal energy on a liquid channel basis so that recording liquid (ink) is caused to be discharged from a plurality of discharge ports 30 arranged in a row. A drive signal is then applied to the electrothermal converters 40 so as to make them generate the thermal energy to cause film boiling, whereby bubbles are formed in the ink liquid channels. The growth of the bubbles is utilized to discharge ink droplets from the discharge ports 30. Each electrothermal converter 40 is provided on a heater board 100 formed of a silicon substrate and together with aluminum wiring (not shown) for supplying power to the electrothermal converter 40, it is integrally formed by a film-formation technique. A top plate 1300 with grooves which is provided with partition walls for separating the plurality of ink channels from one another, a common liquid chamber 1301 for temporarily storing ink to be supplied to each ink channel and the like, an ink receptacle 1500 for leading ink from the ink tank 14 to the common liquid chamber 1301, and an orifice plate 400 having a plurality of discharge ports 30 corresponding to the respective ink channels are integrally formed. This combination should preferably be made of polysulfone but may be formed of other forming resins such as polyethylsulfure, polyphenylene oxide and polyethylsulfone.

The configuration of the ink jet section 13 will subsequently be described. One end of a wiring substrate 200 is connected to the wiring portion of a heater board 100 of the ink jet head 12, whereas a plurality of pads 201 corresponding to the respective electrothermal converters 40 (FIG. 4) for receiving an electric signal from the apparatus proper are provided at the other end of the wiring substrate 200. The electric signal from the apparatus is thus supplied to the electrothermal converter 40.

A metal supports 300 for supporting the backside of the wiring substrate 200 in one plane serves as the bottom plate of the ink jet section 13. A cap spring 500 is M-shaped and used to press the common liquid chamber 1301 (FIG. 4) lightly at the center of the M-shape and to apply concentrated linear pressure to part of the liquid channel, preferably an area close to the discharge ports 30, with its apron 501. The leg of the cap spring 500 is passed through a port 3121 of the supports 300 and mated with the backside of the supports 300 so that the heater board 100 and the top plate 1300 are mated with each other while they are held therebetween and forced to combine firmly with the concentrated bias force of the cap spring 500 and its apron 501. The supports 300 has ports 312, 1900, 2000 mating with the two positioning projections 1012 and the thermal fusion holding projections 1800, 1801 of the ink tank 14 and further projections 2500, 2600 for positioning the carriage 16 on the backside thereof. Moreover, the supports 300 is provided with a port 320 through which an ink supply pipe 2200 (as will be described later) from the ink tank 14 is allowed to pass. An adhesive is used for bonding the wiring substrate 200 to the supports 300.

Recesses 2400, 2400 of the supports 300 are respectively provided close to the projections 2500, 2600 and in the assembled ink jet cartridge 11, its three peripheral sides are located at extended points of the leading end area of the head formed with parallel grooves 3000, 3001 so as to prevent useless articles such as dust and ink from reaching the projections 2500, 2600. A cover member 800 where the parallel grooves 3000 are formed constitutes the outer wall of the ink jet cartridge 11 and forms a space for use in accommodating the ink jet section 13 with the ink tank 14. Moreover, an ink supply member 600 with the parallel grooves 3001 is formed as a cantilever in such a way that one side of an ink conduit 1600 contiguous to the ink supply pipe 2200 is fixed, the one side thereof being located on the ink supply pipe side 2200. In addition, a sealing member 602 is inserted between the fixed side of the ink conduit 1600 and the ink supply pipe 2200 to secure a capillary phenomenon. A packing 601 is provided to couple the ink tank 14 and the ink supply pipe 2200 together. A filter 700 is also provided on the ink tank side 14 of the ink supply pipe 2200.

As the ink supply member 600 is formed by molding, it is inexpensive and free from a precision reduction, and offers high positional accuracy. Moreover, the ink conduit 1600 of cantilever construction is stably kept in pressure contact with the ink receptacle 1500 even when such ink conduits are mass produced. In this embodiment, it is only necessary to pour a sealing adhesive from the ink supply member 600 in this state of the pressure contact therewith to ensure a complete communicating condition. In this case, two pins (not shown) on the backside of the ink supply member 600 are passed through respective ports 1901, 1902 of the support 300 and protruded therefrom and thermally fused to simply secure the ink supply member 600 to the supports 300. As the area slightly protruded from the backside portion thus thermally fused is fitted in a recess (not shown) in the side of the ink jet section 13 of the ink tank 14, the positioning plane of the ink jet section 13 can be obtained with accuracy.

The configuration of the ink tank 14 will subsequently be described. The ink tank 14 comprises a cartridge proper 1000, an ink absorber 900 and a cover member 1100. The ink tank 14 is formed by sealing the ink absorber 900 with the cover member 1100 after inserting the ink absorber 900 into the cartridge proper 1000 from the direction opposite to the ink jet section 13.

The ink absorber 900 is impregnated with ink and used for holding it, the ink absorber being arranged in the cartridge proper 1000; it will be described in detail later. An ink supply port 1200 is intended to supply ink to the ink jet section 13 and serves as a supply port for impregnating the ink absorber 900 with the ink during the process of assembling the ink jet cartridge 11. Moreover, the ink tank 14 is provided with a conventional atmosphere communicating port 1401 for introducing the atmosphere to the inside thereof and a liquid repellent member 1400 is arranged inwardly to prevent ink from leaking out of the atmosphere communication port 1401.

In order to smooth the support of ink from the ink absorber 900 in this embodiment, it is important for the relatively good uniform ink supply to the ink absorber 900 to be effected from the ink supply port 1200 as an air existent area formed with ribs 2300 in the cartridge proper 1000 and partial ribs 2310, 2320 of the cover member 1100 within the ink tank 14 are formed so as to be contiguous to the atmosphere communication port 1401 over the remotest corner area from the ink supply port 1200. This technique is practically very effective. Four of the parallel ribs 2300 are provided in the direction in which the carriage 16 (FIG. 7) moves in the rear of the cartridge proper 1000 of the ink tank 14 to prevent the ink absorber 900 from adhering to the backside thereof. The partial ribs 2310, 2320 are provided on the inner face of the cover member 1100 located correspondingly on its extended line and unlike the ribs 2300, they become divided so that the air existent space is set greater than that of each rib 2300. In this case, the partial ribs 2310, 2320 are left dispersed over a plane half the whole area of the cover member 1100. While stabilizing the ink in the remotest corner area from the ink supply port 1200 of the ink absorber 900, these ribs are capable of ensuring that the ink is introduced to the ink supply port 1200 by means of capillary force.

The ink tank is designed to store ink in a rectangular space and as it is in the shape of a rectangle, the aforementioned rib arrangement is especially effective. In a case where ink is stored in a space having long sides in the direction in which the carriage 16 (FIG. 7) moves or in a cubic, the ribs may be provided over the whole cover member 1100 to stabilize the supply of ink from the ink absorber 900. Although the most suitable space is a rectangular parallellepiped to store ink as much as possible, it is important to provide ribs capable of effecting the aforementioned action on the two-plane area close to the corner areas. Moreover, the inner ribs of the ink tank 14 in this embodiment are distributed substantially uniformly in the direction of the thickness of the rectangular ink absorber 900. This arrangement is designed for the ink amount to be substantially maximized while its atmospheric distribution is uniformized. The technical concept of arranging the ribs will further described in detailed. When a circular arc having the long side as a radius with a position as the center point at which the ink supply port 1200 of the ink tank 14 is projected on the square surface of the rectangular parallellepiped, importance should be attached to arranging the ribs on the surface outside the circular arc so that the atmospheric pressure is applied to the absorber located outside the circular arc as quickly as possible. In this case, the draft port of the ink tank is not restricted to this example as long as it is located to the position where it is able to introduce the air into the area in which the rib is arranged.

In addition, the backside of the ink jet cartridge 11 opposite to the ink jet head 12 is flattened so that the space required is minimized when the ink jet cartridge 11 is incorporated into the apparatus, whereas the amount of ink to be stored is maximized. Consequently, the apparatus can be reduced in size with success with the excellent effect of reducing the frequency of replacing the cartridge. Further, the projected portion of the atmosphere communication port 1401 is formed by utilizing the rear side of the space for use in incorporating the ink jet section 13 and by making the projected portion hollow, an atmospheric supply space 1402 with respect to the whole thickness of the aforementioned ink absorber 900 is formed. With this arrangement, an ink jet cartridge surpassing any conventional ones in performance can be provided. As the atmospheric pressure supply space 1402 is greater than any one of those heretofore in use and located above the atmospheric port 1401, it can temporarily hold ink even if the ink is separated from the ink absorber 900. Therefore, an excellent efficient cartridge can thus be provided.

Figure 5:
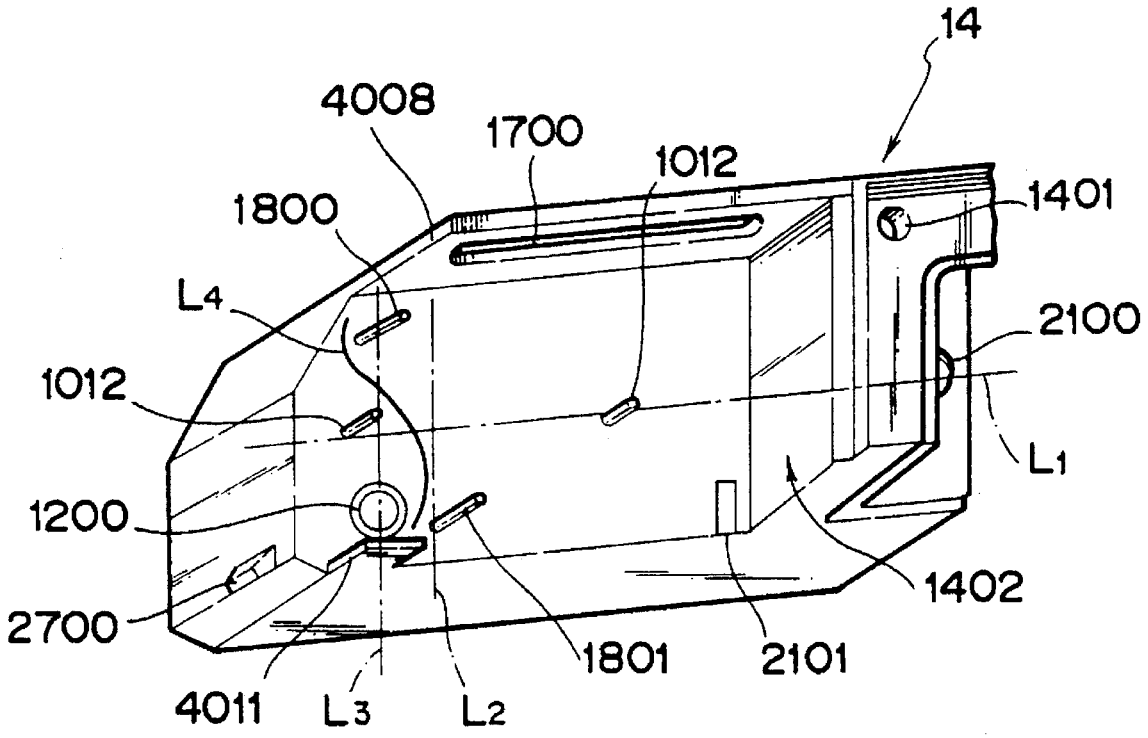
FIG. 5 PRIOR ART
FIG. 5 is a diagram illustrating a portion to which an ink jet section of an ink tank is fitted.
Figure 6:
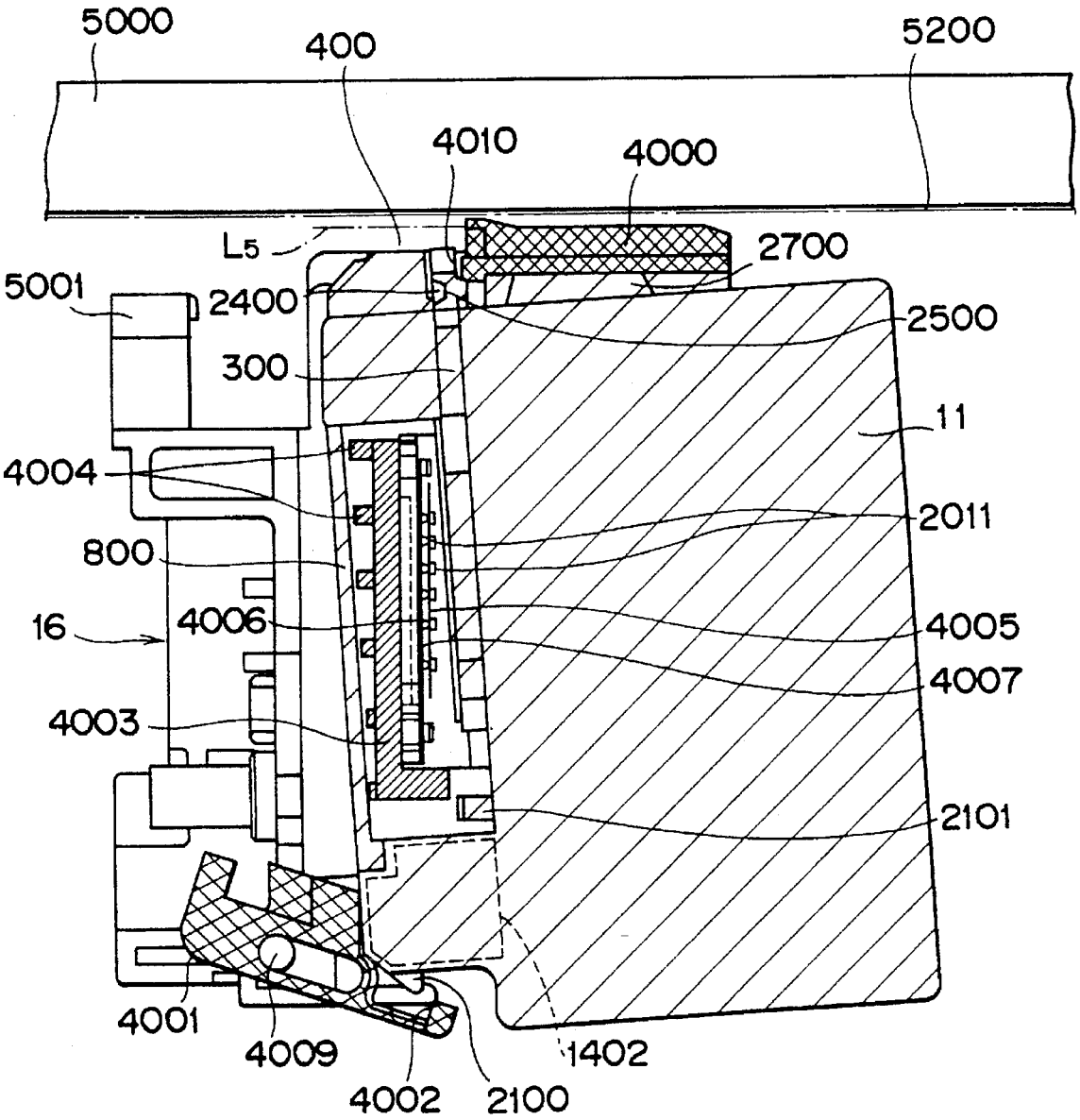
FIG. 6 PRIOR ART
FIG. 6 is a diagram illustrating the process of fitting the ink jet cartridge to an ink jet recording apparatus.

FIG. 5 is a block diagram illustrating a fitting face of the ink jet section of the ink tank 14. Given a straight line L1 passing through the substantially center of the outlet of the orifice plate 400 and paralleling a mounting reference face on the surface of the base of the ink tank 14 or the surface of the carriage 16, the two positioning projections 1012 fitting into the respective ports 312 of the supports 300 are positioned on the straight line L1. The height of the projections 1012 is slightly less than the thickness of the supports 300 and used to position the supports 300. As shown in FIG. 6, a click 2100, with which a 90-degree mating face 4002 of a hook 4001 for positioning the carriage 16 mates, is positioned on the extended straight line L1 of FIG. 5, so that the planar area in parallel to the reference face including the straight line L1 acts on the positioning of the carriage 16. As will be described later, these relations help to make the aforementioned arrangement effective as the precision of positioning only the ink tank 14 and that of positioning the outlets of the ink jet head 12 are equalized. Moreover, the projections 1800, 1801 of the ink tank 14 respectively corresponding to the ports 1900, 200 for use in securing the supports 300 to the side of the ink tank 14 are longer than the projection 1012 and used to secure the supports 300 to the side thereof by thermally fusing the parts of the projections protruded from the supports 300. Given a straight line L3 passing the projection 1800 in the direction perpendicular to the line L1 and a straight line L2 passing the projection 1801 in the same way, the substantially center of the ink supply port 1200 is located on the straight line L3. As a result, the ink supply port 1200 and the ink supply pipe are stably coupled and the load applied to them is decreased even though they are subjected to falling and a shock. Moreover, the effect of positioning the ink jet head 12 and the ink tank 14 is further reinforced as the straight lines L2, L3 disagree and as the projections 1800, 1801 exist on the periphery of the projection 1012 on the outlet side of the ink jet head 12. A curve line L4 indicates the position of the outer wall at the time of fitting the ink supply member 600. Since the projections 1800, 1801 are set along the curved line L4, they provide satisfactory strength and positional precision against the weight of the arrangement at the leading end of the ink jet head 12. A collar 2700 at the leading end of the ink tank 14 is inserted into the port of a front plate 4000 (FIG. 6) of the carriage 16 in preparation for irregularities arising at such a time for displacement of the ink tank 14 becomes excessive. A bar (not shown) of the carriage 16 is provided with a stopper 2101, which is used as a protective member for keeping the carriage in position even if the force of undesirably separating it from the fixed position upwardly acts when the ink jet cartridge 11 enters below the bar at the position it has been revolved and fitted.

When the ink tank 14 is covered with the cover member 800 after the ink jet section 13 is completely fitted thereto, the ink jet section 13 excluding its bottom opening is enclosed thereby. Notwithstanding, the ink jet cartridge 11 is to practically form an completely enclosed space as the bottom opening for accommodating the carriage 16 is situated close to the carriage 16. Although heat radiating from the ink jet head 12 in that enclosed space is effective in warming the inside of the space, it may also causes a slight temperature rise therein if the ink jet head 12 is used for hours. For this reason, a slit 1700 narrower than the space is provided above the ink jet cartridge 11 to assist the natural heat radiation of the supports 300. In this way, it becomes possible to make the distribution of heat uniform all over the ink jet section 13 which is unaffected by the environment while a temperature rise is prevented.

When the ink jet cartridge 11 is thus assembled completely, ink is supplied from the cartridge proper 1000 into the ink supply member 600 via the ink supply port 1200, a port 320 provided in the supports 300 and an inlet provided in the mid-rear side of the ink supply member 600. After the ink passes through the interior, it is made to flow from an outlet into the common liquid chamber via a proper supply pipe and the ink receptacle 1500 of the top plate 1300. Packing of silicone rubber, butyl rubber or the like, for instance, are arranged for connections of introducing ink, whereby the ink is sealed to an extent sufficient to secure an ink supply channel.

Since the ink supply member 600, the top plate 1300, the orifice plate 400 and the cartridge proper 1000 are formed into the respective integral section, not only assembly accuracy at a high level but also quality improvement effective in mass production can be implemented. In addition, the number of parts is by far smaller than what is required in the prior art to ensure that desired superior characteristics are demonstrated.

As shown in FIG. 2, it has been so arranged that there exists a gap 1701 between a front plate 603 of the ink supply member 600 and the end portion 4008 of the roof equipped with the narrow opening 1700 of the ink tank 14. Similarly, a gap (not shown) is formed between the underside 604 of the ink supply member 600 and the side end portion 4011 of a thin head member to which the cover member 800 of the ink tank 14 is bonded. These gaps promote the heat radiating action through the aforementioned opening 1700 and even though there is produced the useless force applied to the ink tank 14, it is prevented from being directly applied to the ink supply member 600 and therefore to the ink jet section 13.

In any case, the aforementioned system configuration has never been existed before and each of the components therein can independently achieve an excellent effect and these components in combination can further demonstrate a very dependable result.

A description will subsequently be given of a method of fitting ink jet cartridge 11 to the carriage 16. In FIG. 6, a platen roller 5000 guides a recording medium 5200 (e.g., recording paper and the like) in the back-paper direction. The carriage 16 moves along the longitudinal direction of the platen roller 5000 and there are, ahead of the carriage 16, that is, on the platen roller side 5000, a front plate 4000 (2 mm thick) positioned on the front side of the ink jet cartridge 11, a support plate 4003 for electrical connection as will be described later, and a positioning hook 4001 for fixing the ink jet cartridge 11 at a predetermined recording position. The front plate has two positioning protruded faces 4010 corresponding to the projections 2500, 2600 of the supports 300 of ink jet cartridge 11 and vertical force directed to the protruded faces 4010 is applied to the front plate 4000 after the ink jet cartridge 11 is fitted. Consequently, a plurality of ribs (not shown) for reinforcing purposes are directed to the vertical force on the platen roller side 5000 of the front plate 4000. The rib also forms a head protective projection projecting slightly from the front positions L5 (about 0.1 mm) toward the platen roller 5000 at the time the ink jet cartridge 11 is fitted. The support plate 4003 has a plurality of reinforcing ribs 4004 extending in the direction perpendicular to the drawing and the percentage of side projection decreases toward the hook side 4001 from the platen roller side 5000, whereby the ink jet cartridge 11 is fitted in such a manner that it inclines as shown in the drawing. Moreover, the support plate 4003 holds a flexible sheet 4005 equipped with pads 2011 corresponding to the pad 201 of the wiring substrate 200 of the ink jet cartridge 11 and a rubber pad sheet 4007 with a botch for generating elastic force for pressing each pad 2011 from the back side. The support plate 4003 provides a positioning face 4006 corresponding the protruded face 4010 on the hook side 4001 to apply active force to the ink jet cartridge 11 in the direction opposite to the acting direction of the protruded face in order to stabilize the electrical contact between the pads 201 and 2011. The support plate 4003 also forms a contact area therebetween and defines the amount of deformation of the botch of the rubber sheet 4007 corresponding to the pad 2011. The positioning face 4006 keeps in contact with the surface of the wiring substrate 200 when the ink jet cartridge 11 is fixed at the position where recording can be implemented. As the pads 201 are distributed symmetrically about the line L1, the amount of deformation of each botch of the rubber sheet 4007 is uniformized and the contact pressure between the pads 2011 and 201 is stabilized. In this embodiment, the pads 201 are distributed in upper two rows, lower two rows and vertical two rows.

The hook 4001 has a slit mating with a fixed shaft 4009 and while utilizing the moving space provided by the slit, first revolves counterclockwise from the position shown in the drawing and then moves to the left-hand side along the longitudinal direction of the platen roller 5000 in order to position the ink jet cartridge 11 with respect to the carriage 16. Although the hook 4001 may be moved optionally, it should preferably be moved by a lever. In any way, while the hook 4001 is revolving, the ink jet cartridge 11 moves toward the platen roller 5000, thus causing the positioning projections 2500, 2600 to move to a position where they comes in contact with the protruded face 4010 of the front plate 4000. As the hook 4001 moves to the left-hand side, the 90-degree hook face 4002 comes in close contact with the 90-degree face of the click 2100 of the ink jet cartridge 11 and the ink jet cartridge 11 revolves in the horizontal plane centering around the contact area between the projection 2500 and the protruded face 4010, whereby the pads 201 and 2011 ultimately begin to contact each other. When the hook 4001 is held at a predetermined position, that is, at a fixing position, there are simultaneously formed the complete contact condition between the pads 201 and 2011, the complete contact condition between the projections 2500, 2600 and the protruded face 4010, the two-side 90-degree contact between the hook face 4002 and the click 2100, and the contact between the wiring substrate 200 and the positioning face 4006. As a result, the ink jet cartridge 11 is firmly held with respect to the carriage 16.

The ink jet recording apparatus will subsequently be summarized.

Figure 7:
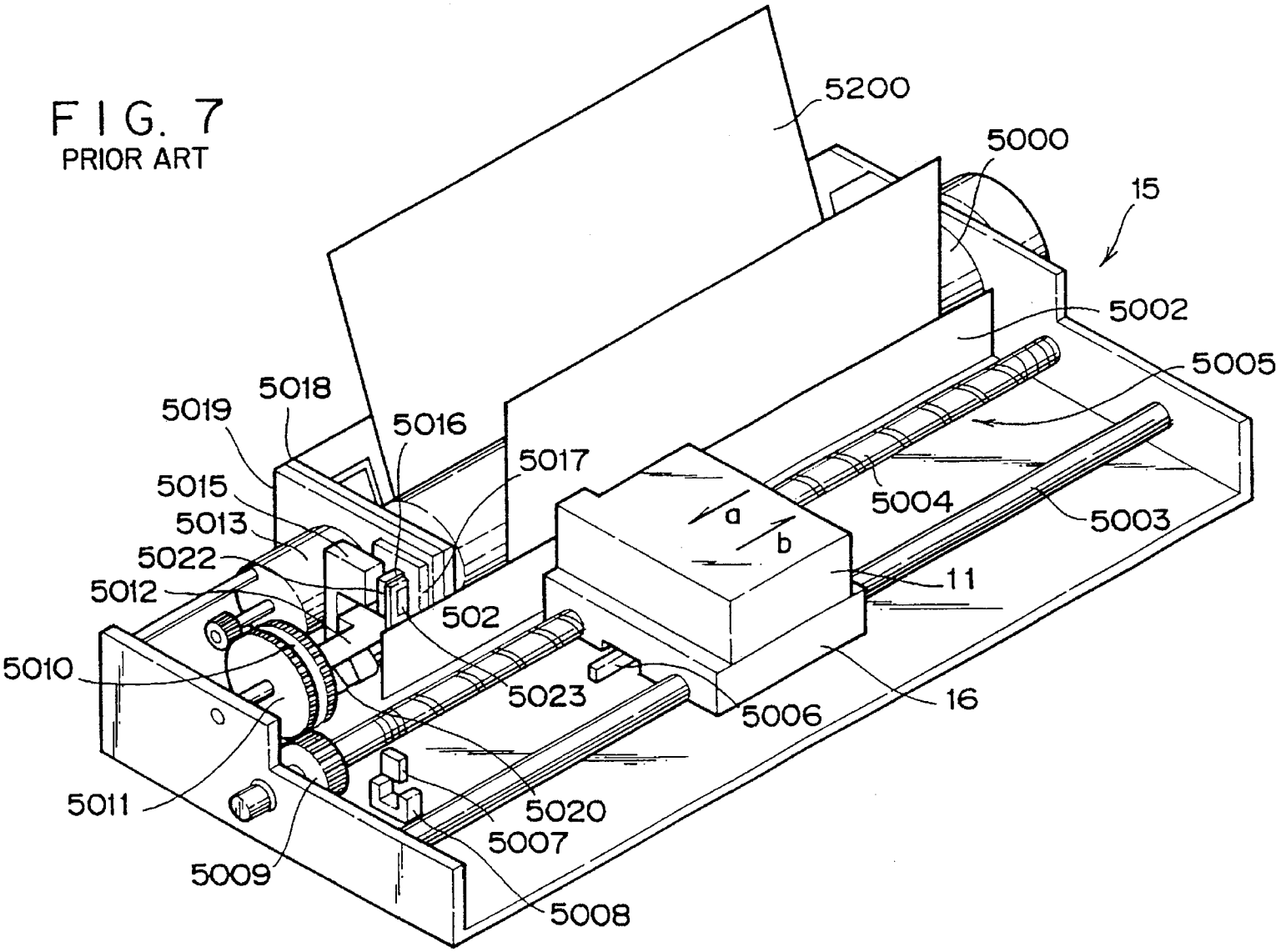
FIG. 7 PRIOR ART
FIG. 7 is a schematic perspective view of the ink jet recording apparatus.

FIG. 7 is a schematic view of the ink jet recording apparatus 15 to which the present invention is applied. A lead screw 5005 having a spiral groove 5004 is interlocked with a drive motor 5013 and driven to rotate via driving force transmission gears 5011, 5009 in harmony with the forward or backward rotation thereof. The carriage 16 reciprocates in directions of arrows a and b when its pin (not shown) fitted to a fitting part 5001 (FIG. 6) mates with a linear groove 5004 and when it is slidably guided by a guide rail 5003. A paper presser plate 5002 is made to press the recording medium 5200 against the platen roller 5000 over the whole moving direction of the carriage 16. Photocouplers 5007, 5008 constitute a home position detecting means for reversing the direction of rotation of the drive motor 5013 by confirming the presence of the lever 5006 of the carriage 16 in this area. A cap member 5022 for capping the front of the ink jet head 12 is supported by a support member 5016 and equipped with a suction means 5015 in order to effect suction recovery of the ink jet head 12 via an opening 5023 within the cap. A support plate 5019 is fitted to a body supporting plate 5018 and a cleaning blade 5017 slidably supported by the support plate 5019 is longitudinally moved by a drive means (not shown). The configuration of the cleaning blade 5017 is not limited to what is shown and any known configuration may needless to say be applicable to the present invention. The lever 5012 is intended to start the suction recovery operation and as a cam 5020 in contact with the carriage 16 moves, it moves and is controlled by any known means for switching the drive force from the drive motor 5013 via a gear 5010, a clutch and the like.

These capping, cleaning and sucking processes are performed at the respective corresponding positions in response to the action of a lead screw 5005 when the carriage 16 is situated in the area in the home position. Provided the desired operation is performed at known timing, the present invention is applicable to any one of the aforementioned operations. The aforementioned superior arrangement made independently or in combination constitutes a preferred embodiment of the present invention.

The atmosphere communicating section as the principal part in the embodiment of the present invention will subsequently be described in detail.

Figure 1:
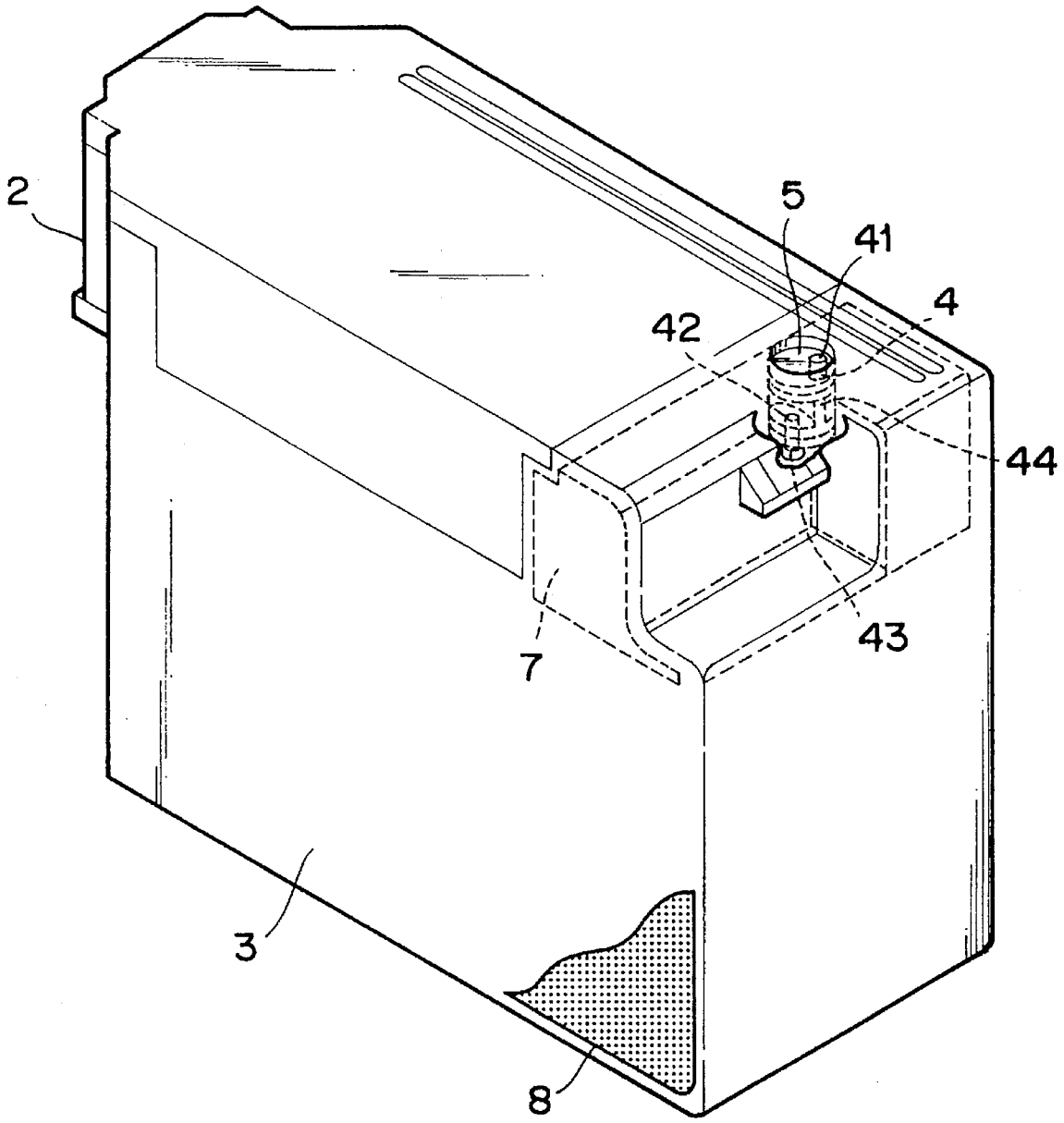
FIG. 1 is a perspective view of an ink cartridge embodying the present invention.
Figure 8:
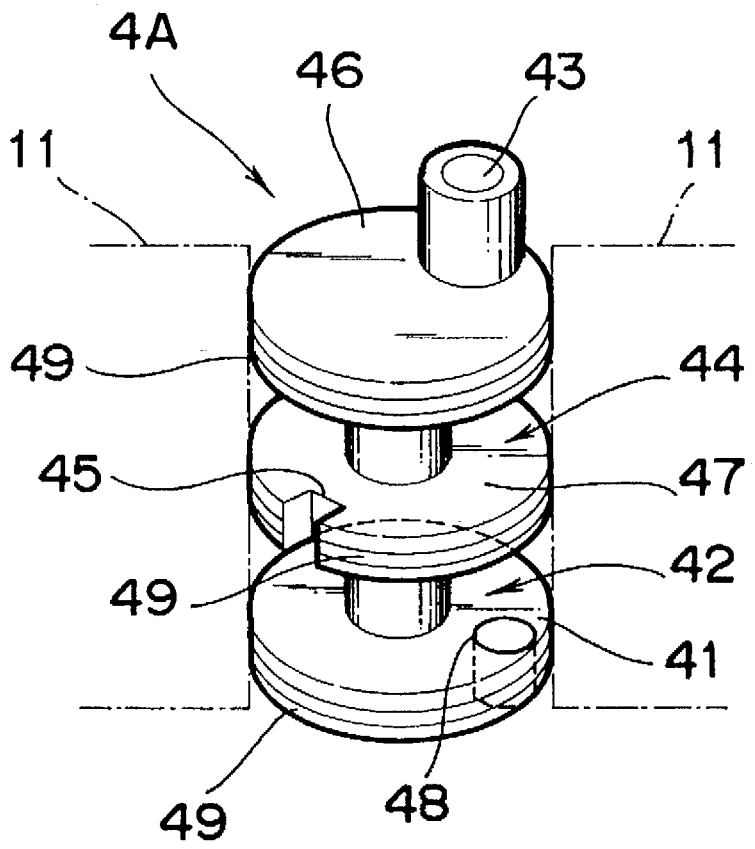
FIG. 8 is a perspective view of another cap member embodying the present invention.
Figure 9A:
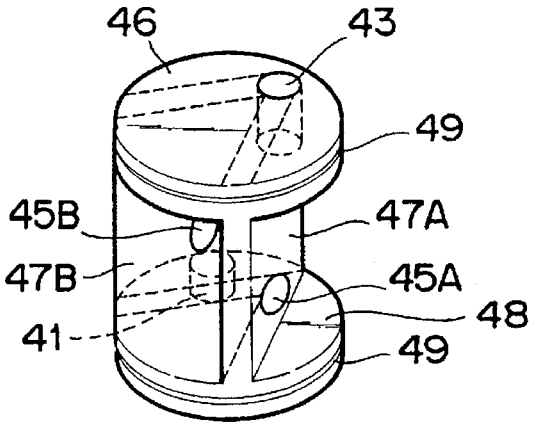
FIGS. 9A to 9C are perspective views of cap member constructions respectively forming atmosphere communicating sections.

FIG. 1 is a perspective view of the whole recording head cartridge, illustrating the part of the atmosphere communicating section. In FIG. 1, numeral 2 denotes a recording head for causing liquid droplets to be discharged according to an electric signal, 3 a tank for storing recording liquid to be supplied to the recording head 3, 4 an atmosphere communicating section for equalizing the internal pressure of the tank 3 and the atmospheric pressure, 5 a cap member for forming an atmosphere communicating port and a plurality of chambers, 8 a porous material for holding the recording liquid, and 7 a buffer chamber for preventing ink leakage due to temperature and pressure changes, the buffer chamber forming the non-contact condition between the porous material 8 and the atmosphere communicating section 4. FIG. 9C illustrates in detail the construction of the atmosphere communicating section of FIG. 1 upside down. FIG. 10 is a sectional view of each opening of FIG. 1. As is obvious from these drawings, the atmosphere communicating section comprises an inner opening 43, an inner chamber 44, a chamber-to-chamber opening 45, an outer chamber 42 and an projecting portion opening 41, these communicating with the atmosphere or the outside air. Although the atmosphere communicating section is formed by inserting the outlet 49 (like a flash that can be deformed when it is forced to enter at a pressure of about 0.1 mm) of the cap member into the cylindrical inner wall of the ink tank as shown in FIGS. 8, 9, it may be a construction to be fitted to the outer wall of the ink tank in conformity with the object of the present invention.

There is provided a pipe-like opening directed to the inside of the ink tank and a partition plate or wall 47 to form two rooms when the ink tank is fitted to the cylindrical opening of a tank housing. The partition plate has a port so that the two rooms communicate with each other. One of the two rooms is opened to the inside of the ink tank and the other is opened to the atmosphere outside the ink tank. The pipe-like opening is fitted in such a way that it is directed to the inside of the ink tank. Each opening should preferably be positioned at the center of gravity of the face opening to each room. Moreover, the port bored in the partition plate for dividing the space should preferably be installed in the direction perpendicular to the partition plate through the center of gravity of the partition plate likewise. The inner diameter of the pipe should have an opening not smaller than 0.5 mm and not greater than 1.0 mm in diameter. Each opening in this embodiment is set to have a diameter of 0.8 mm. An opening 41 as the last one should preferably be so processed as to have a diameter smaller than any inner opening. In view of the spirit of the present invention, the most suitable diameter of the opening 41 as the last one is 0.7 mm.

FIG. 10 is a sectional view of the cap member in as installed condition. The pipe-like opening is longer than the ink housing by what protrudes therefrom and the length L should preferably be L>0.5 mm from the housing plane. It it shorter than what has been defined above, scattering ink may be introduced into the atmosphere communicating port, thus easily causing ink leakage.

In case the scattering ink is allowed to enter the pipe, the tank is temporarily hermetically sealed. If ink is consumed in this state, the inner pressure of the ink cartridge decreases and if the ink is consumed further, the ink cannot be discharged any longer. Therefore, the diameter has to be set so that the inner pressure of the tank is reduced to the extent that the ink in the pipe is drawn before defective printing occurs. Otherwise, the ink in the pipe may be drawn as the inner pressure of the tank lowers when the ink is consumed because of the recovery operation.

With the structure of the pipe-like projection, the whole cubic volume of ink droplets is not allowed to enter the pipe even though they scatter and most of them are led out. It is more effective to attach C to the leading end of the pipe or reduce the wall thickness of the pipe. A first buffer chamber is provided at one end of the pipe. Part of the ink thus scattered is introduced into the chamber in which it is stored even though it moves because of falling vibration and the like.

In the case of the conventional atmosphere communicating port construction, spare ink had to be supplied because the amount of evaporation was large and because the amount of evaporation after the opening of the package was still large. The storage of the spare ink in the cartridge caused the frequency of ink leakage because of falling vibration to increase.

Figure 13:
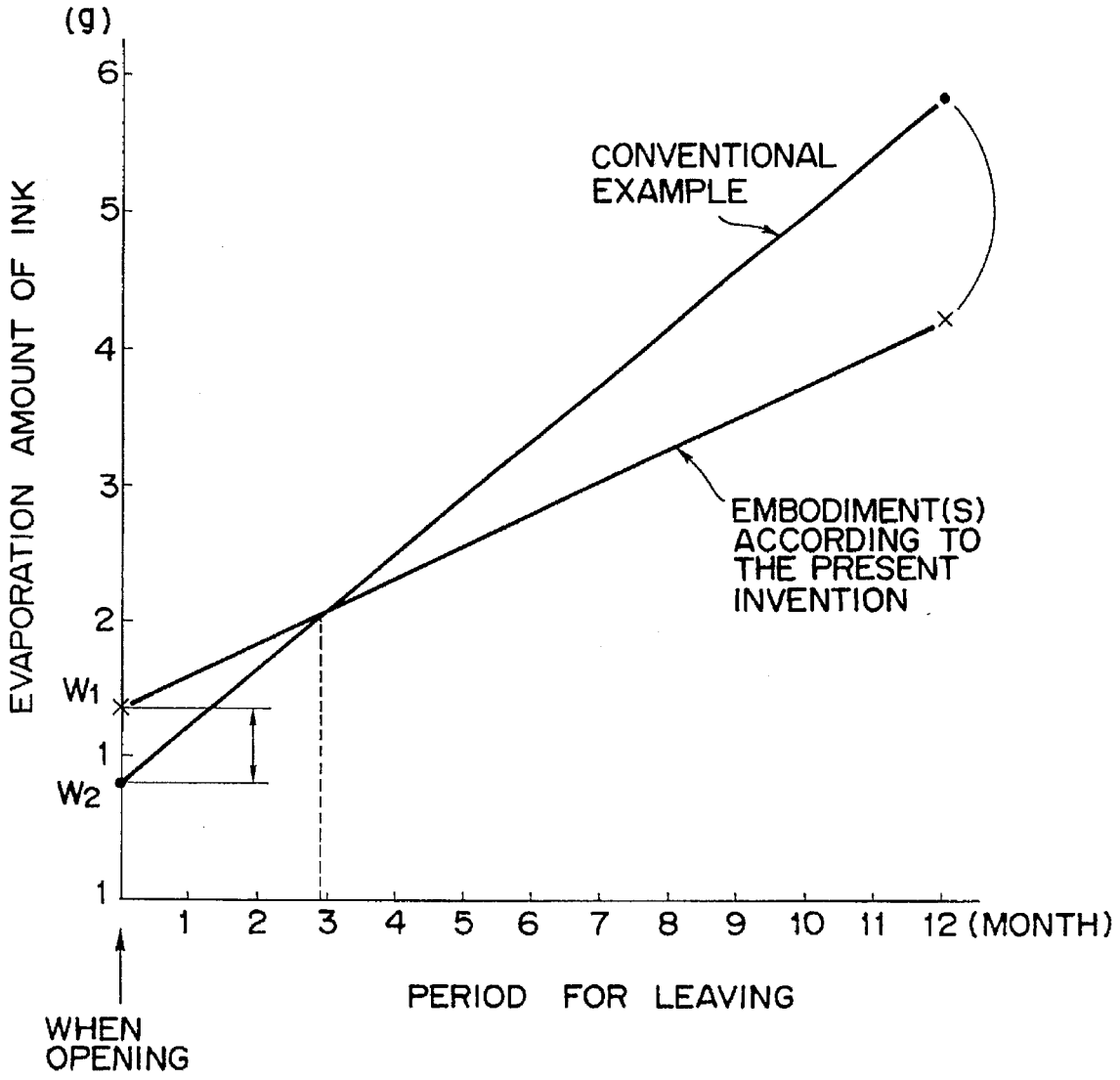
FIG. 13 is a graph illustrating the effect of preventing ink evaporation in the embodiment of the present invention.

The amount of evaporation according to the present invention can be reduced to about 0.6 times as compared with the prior art, whereby the number of sheets for printing is increased with the same amount of ink filled in the tank as before. Since the amount of evaporation is small, the degree of freedom in selecting the package material increases. FIG. 13 shows the amount of evaporation after the package is unsealed. As shown in FIG. 13, the amount of evaporation immediately after the opening of the package is W2, whereas the amount of evaporation in the case of another package containing the ink cartridge equipped with the atmosphere communicating section according to the present invention is as large as W1. However, the difference in the amount of evaporation after the opening of the package reverses the situation in the course of their use. In this way, an allowable range of evaporation in the packaged state can be widened. As a result, it is possible to reduce the thickness of the package heretofore in use from, for instance, 1 mm to 0.6 mm. By reducing the thickness, not only material cost but also productivity can be increased. Moreover, an aluminum film deposited onto the cover can replace an additional layer of aluminum foil that has conventionally been employed. As far as the cover is concerned, the labor is decreased to the extent that the aluminum layer can be dispensed with and it becomes less expensive. An example of a package provided with the atmosphere communicating port according to the present invention will be shown as follows:

An example of package:

| | |
|---|---|
| Package wrapping material: Wall thickness: | 0.6 mm |
| Package cover 6033 outermost layer PET 12 μ | |
| (Layer structure) | Aluminum 0.05 μ |
| | Nylon 15 μ |
| | PE 25 μ |
| | EVA peel layer 25 μ |

Figure 14:
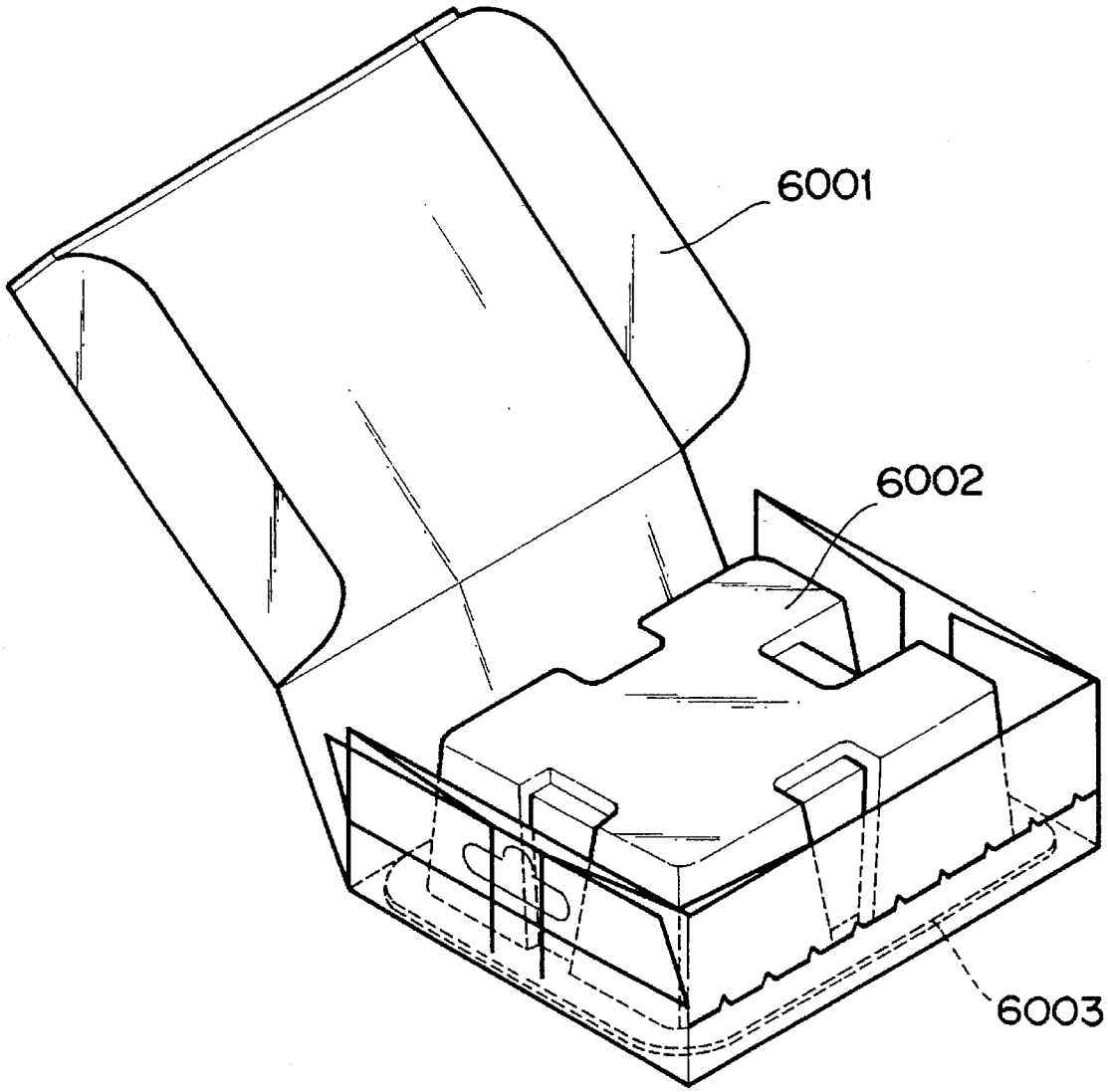
FIG. 14 is a perspective view of the ink cartridge packaged according to the present invention when it is unsealed.

The ink jet cartridge is contained in the aforementioned package and further packaged in a box 6001 as shown in FIG. 14.

Figure 9B:
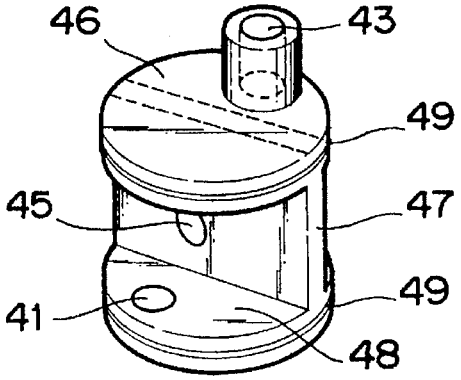
Figure 9C:
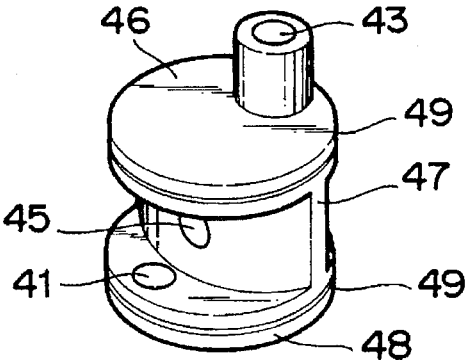
Figure 10:
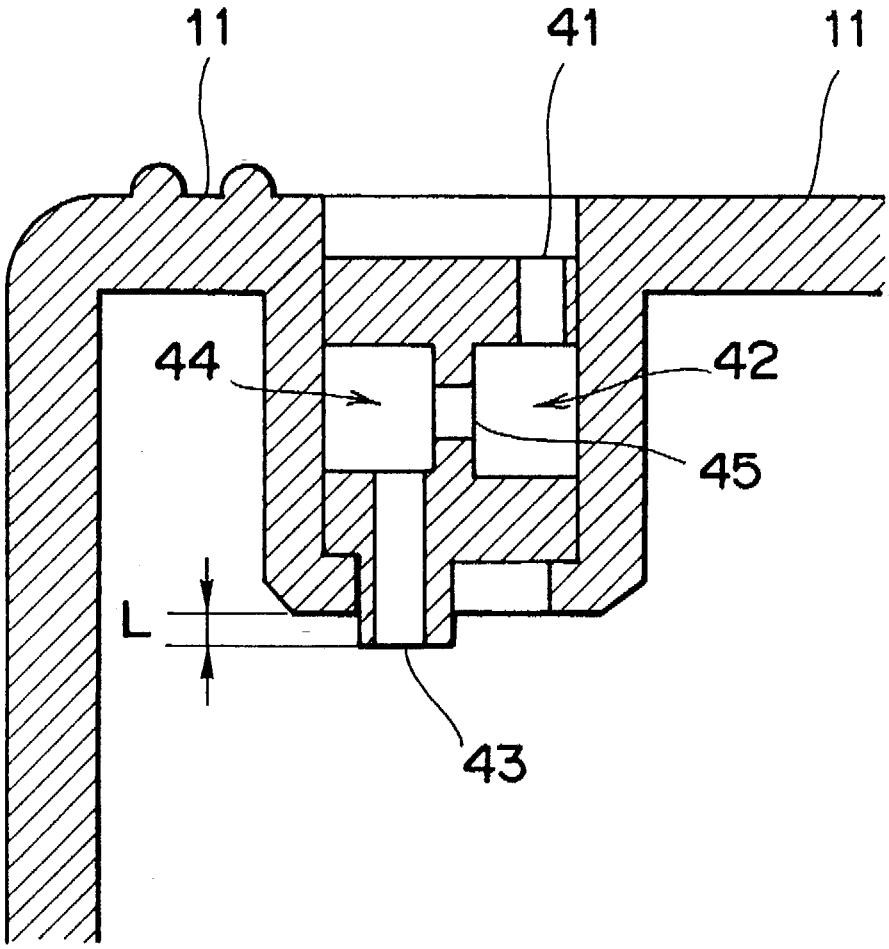
FIG. 10 is a sectional view of the atmosphere communicating section of FIG. 1 according to the present invention.

FIG. 9B shows another version of FIG. 9C wherein the partition plate in the preceding embodiment is made a flat plate and simplified in configuration.

FIG. 8 illustrates a cap member to be arranged for a plurality of chambers to be placed in a direction in which the atmospheric portion is directed from the inside to the outside. In this method, two rooms thus separated are provided.

FIG. 9A refers to a construction wherein the atmospheric chamber is divided into three rooms.

By providing the plurality of buffer chambers, the construction tends to become complicated and may result in an increase in cost but it is still effective to the extent that ink leakage can be dealt with a great deal of buffer.

Figure 11A:
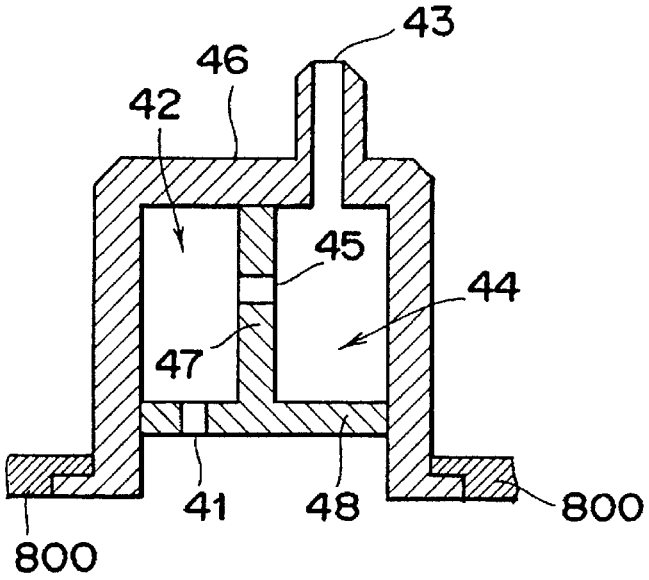
FIGS. 11A and 11B are sectional views of other embodiments of the present invention.
Figure 11B:
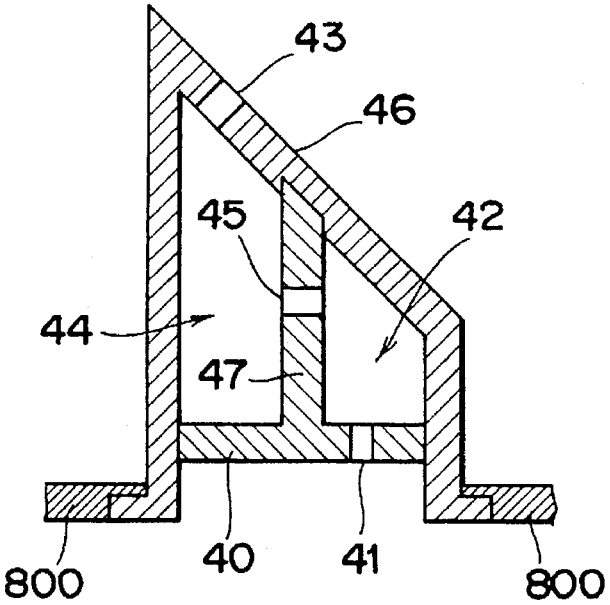

Although the aforementioned cap member has been constructed integrally, it may needless to say be formed separately or combined with the tank housing. FIGS. 11A, 11B show examples of tank housings 800, each being provided with piping.

Further, FIG. 11B illustrates a construction wherein the upper portion 46 of a pipe is inclined with a port in a portion close to the peak. The inclined portion is formed with a tank housing. Even though the pipe is thus constructed, the same effect as that of the aforementioned pipe is obtainable. As the scattered ink is made to flow along the inclination, the amount of ink flowing through the port is minimized. In addition, the effect of the partitioned room is utilized to prevent ink leakage.

In FIG. 1, numeral 5 denotes a cap member reflecting the present invention. As shown in FIG. 1, the cap member is recessed by one step from the wall of the recording head cartridge proper. This is intended to prevent hands of users from being stained with ink in case the ink spills off the atmosphere communicating port 4.

Figure 12:
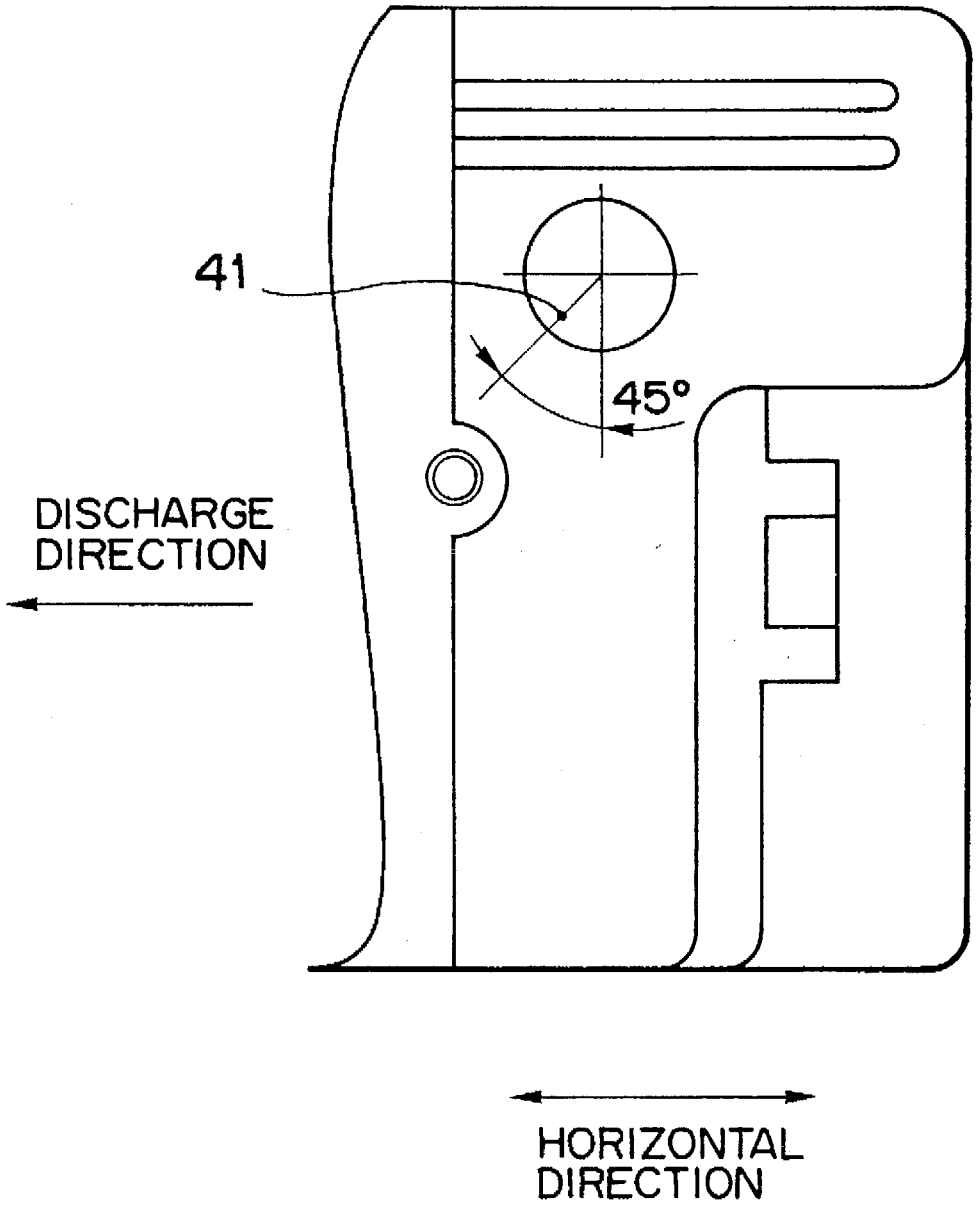
FIG. 12 is a partial side view of the embodiment of the present invention of FIG. 1.

FIG. 12 refers to a state in which the cap member has been fitted to the ink tank according to the present invention. When the opening 41 on the atmospheric side is horizontally fitted, the opening should preferably be installed so that it faces 45-degree downward in the horizontal direction from the center of the atmosphere communication section. The opening toward the atmosphere is not located directly below as it is fitted in the (–) relationship and may be least clogged with extraneous matter such as dust. Moreover, the ink cartridge according to the present invention may be used for downward printing with respect to the outlet. In such a case, the opening toward the atmosphere is not also located directly below as it is fitted in the aforementioned relationship. With the fitting position above, the opening on the ink tank side is always located above the atmosphere communicating section and this makes it difficult for ink to stick to the atmosphere communicating section.

FIG. 14 is a block diagram illustrating a case body 6002 contained in the cartridge and a cover 6003 are housed and held in the box 6001 in order to prevent the cartridge from being damaged in the course of distribution, to make it pleasant in appearance in view of sale and to ease any shock at the time the contents are unsealed by minimizing the trouble of unsealing them. The box 6001 is, as shown in FIG. 14, substantially rectangular parallelepipedic in appearance and has a zipper member for opening it on one side of the long side and a hook for exhibiting purposes on one side of the short side. The box 6001 is divided into a released cover side and a case containing side when it is unsealed by stripping off the zipper member. The hook for exhibiting purposes is provided on the case containing side. The atmosphere communicating section is thus constructed according to the present invention, the thickness of the package for preventing evaporation can be reduced, whereby the total cost can be lowered.

With respect to the typical construction and the principle of the recording head, use may preferably be made of the basic principle disclosed in U.S. Pat. Nos. 4,723,129 and 4,740,796. This system is applicable to both the on-demand type and the continuance type and in the case of the on-demand type in particular, at least one drive signal for causing a sharp temperature rise exceeding mucleate boiling corresponding to recording information is applied to an electrothermal converter arranged in accordance with a sheet or a liquid channel which holds liquid (ink) so as to make the electrothermal converter generate thermal energy, thus causing film boiling on the thermal action plane of the recording head; this results in effectively generating bubbles in the liquid (ink) corresponding one-to-one to the drive signal. The growth and contraction of the bubbles are utilized to cause the liquid (ink) to be discharged via the outlet opening, so that at least one droplet is formed. As the growth and contraction of bubbles are effected instantly and properly, provided the drive signal is in the form of a pulse, the discharge of the liquid (ink) excellent in response characteristics can be accomplished. As the drive signal in the form of a pulse, those described in U.S. Pat. Nos. 4,463,359 and 4,345,262 are fit for use. The use of the conditions described in U.S. Pat. Nos. 4,313,124 on the invention relating to a temperature rise ratio on the thermal action plane further ensures excellent recording.

Although the liquid for use in the embodiment shown has been described as ink, it may be of any type as long as it liquefies at the time a recording signal for use is applied, since temperature control is exercised in such a way that the ink itself in the case of the aforementioned ink jet is subjected to temperature adjustment within a range of not lower than 30° C. to not higher than 70° C. so as to make the ink soften or liquefied at the room temperature or to set the ink viscosity to a stable discharge range even if it is what solidifies at or lower than the room temperature. In addition, ink is prevented from evaporating by positively employing the temperature rise caused by thermal energy as what changes the solid form of the ink into its liquid form or otherwise by employing such ink as to solidify when it is left as it is, whereby the ink liquefied by the thermal energy for the first time is also applicable to the present invention anyhow, the ink including what is liquefied by applying the recording signal of thermal energy correspondingly and discharged as liquid ink or what begins to solidify by the time it reaches a recording medium. In these cases, ink in the form of liquid or solid may be held in a recess of a porous sheet or in a through-hole before being placed opposite to the electrothermal converter as described in Japanese Patent Laid-Open No. 54-56847 or No. 60-71260.

[Effect of the Invention]

As set forth above, the ink container having the aforementioned atmosphere communicating construction, the recording head or the large-sized tank (which may in this case have a plurality of atmosphere communication sections) according to the present invention prevents recording liquid in the tank from leaking out via the atmosphere communicating port because of a shock and vibration, thus driving away a general feeling of uneasiness on the part of users deriving from the possibility of soiling their hands and clothes.

Moreover, ink leakage has been prevented by extending a seal tape for stopping up the outlet up the atmosphere communication port to fill up the atmosphere communicating port in the prior art form of packaging the ink cartridge. However, it is unnecessary to extend the seal tape up to the atmosphere communicating port and consequently the seal tape can be shortened or the package can be simplified with the overall effect of reducing cost. In addition, while the freedom of selecting package material is extended, the recording liquid can be used more effectively than before during the period of its use on the part of the user.

What is claimed is:

1. An ink container having an ink containing section for containing ink, a buffer chamber communicating with said ink containing section and an atmosphere communicating section communicating with outside air, said atmosphere communicating section comprising:

a plurality of chambers disposed between an inside of said ink containing section and the outside air; and a communicating port opening communicating each of said chambers with another of said chambers, said communicating port opening being smaller in size than each of said chambers communicating therewith, wherein a portion of said atmosphere communicating section including an inner opening communicates with the inside of said ink containing section through the buffer chamber, and said portion projects into the buffer chamber.

2. An ink container as claimed in claim 1, wherein said plurality of chambers are located adjacent to each other in a direction intersecting a direction from an inner opening communicating with said ink containing section to an outer opening of said atmosphere communicating section.

3. An ink container as claimed in claim 2, wherein said atmosphere communicating section has an inclined surface against an inner surface of said ink containing section, and said inner opening is disposed in said inclined surface.

4. An ink container as claimed in claim 2, wherein said atmosphere communicating section further comprises a cap member with a partition wall providing said plurality of chambers.

5. An ink container as claimed in claim 4, wherein an inner side surface of said cap member against said ink containing section is inclined relative to a line connecting said inner opening of said container to an outer opening of said container.

6. An ink container as claimed in claim 4, wherein said partition wall has therein said communicating port opening disposed substantially perpendicular to said partition wall and proximate to the center of gravity of said partition wall.

7. An ink container as claimed in claim 2, wherein said communicating port opening is offset from the position of said inner opening and said outer opening.

8. An ink container as claimed in claim wherein said atmosphere communicating section has an inner opening for communicating with the buffer chamber, said inner opening having a tubular configuration projecting toward said buffer chamber.

9. An ink container as claimed in claim 8, further including a porous material disposed in said inside of said ink containing section for holding ink, wherein said buffer chamber is disposed between said inner opening and said porous material.

10. An ink container as claimed in claim 8, wherein said tubular configuration of said inner opening extends toward said buffer chamber more than 0.5 mm from a wall of said atmosphere communicating section.

11. An ink container as claimed in claim 1, wherein said atmosphere communicating section is held in an outer wall of said ink container.

12. An ink container as claimed in claim 1, wherein said atmosphere communicating section includes an outer opening communicating with the outside air and being disposed on a line extending downward from a center of said atmosphere communicating section at 45° to a horizontal direction perpendicular to the direction of gravity.

13. An ink container as claimed in claim 1, wherein said plurality of chambers are so arranged that a capacity of an inside chamber increases over a capacity of the chamber.

14. An ink jet head comprising a recording head for discharging recording liquid and a tank having ink storage means for storing said recording liquid in an interior thereof, said recording head and said tank being integral with each other, and said tank further having a buffer chamber communicating with said ink storage means and atmosphere communicating means for equalizing atmospheric pressure and pressure in said interior of said ink storage means, wherein said atmosphere communicating means includes:

a plurality of chambers;

a port communicating each of said chambers with another of said chambers;

an opening communicating one of said chambers with said interior of said ink storing means through the buffer chamber, said opening having a tubular configuration projecting into the buffer chamber; and a vent communicating another of said chambers with atmosphere.

15. An ink jet apparatus comprising:

an ink container having an ink containing section for containing ink, a buffer chamber communicating with said ink containing section and an atmosphere communicating section communicating with outside air, said atmosphere communicating section including a plurality of chambers disposed between an inside of said ink containing section and the outside air, and a communicating port opening communicating each of said chambers with another of said chambers, said communicating port opening being smaller in size than each of said chambers communicating therewith;

a recording head supplied with the ink from said ink container;

scanning means for scanning said recording head relative to a recording medium; and conveying means for conveying said recording medium, wherein a portion of said atmosphere communicating section including an inner opening communicates with the inside of said ink containing section through the buffer chamber, and said portion projects into said buffer chamber.

16. An ink container having an ink containing section for containing ink, a buffer chamber communicating with said ink containing section and an atmosphere communicating section communicating with outside air, said atmosphere communicating section comprising:

a first chamber having an inner opening projecting into the buffer chamber and communicating said first chamber with said ink containing section through the buffer chamber;

a second chamber having an outer opening communicating said second chamber with the outside air; and a communicating port communicating said first chamber with said second chamber, said communicating port being smaller than said first and second chambers.

17. An ink container as claimed in claim 16, wherein said atmosphere communicating section comprises a cylindrical opening in said ink container and a cap member being in contact with an inner wall of said cylindrical opening and having a partition wall, said cap member contacting said wall of said cylindrical opening to form said first and second chambers.

18. An ink container as claimed in claim 17, wherein said partition wall is provided along the direction that said inner wall of said cylindrical opening extends.

19. An ink jet apparatus comprising:

an ink container having an ink containing section for containing ink, a buffer chamber communicating with said ink containing section and an atmosphere communicating section communicating with outside air, said atmosphere communicating section including a first chamber having an inner opening projecting into the buffer chamber and communicating said first chamber with said ink containing section through the buffer chamber, a second chamber having an outer opening communicating said second chamber with the outside air, and a communicating port communicating said first chamber with said second chamber, said communicating port being smaller than said first and second chambers;

a recording head supplied with the ink from an inside of said ink container;

scanning means for scanning said recording head relative to a recording medium; and conveying means for conveying said recording medium.

* * * * *

UNITED STATES PATENT AND TRADEMARK OFFICE

CERTIFICATE OF CORRECTION

PATENT NO. : 5,629,728

DATED : May 13, 1997

INVENTOR(S) : SEIICHIRO KARITA, ET AL.

It is certified that error appears in the above-identified patent and that said Letters Patent is hereby corrected as shown below:

COLUMN 2
Line 11, "provided" should read --provide--.

COLUMN 3
Line 21, "the" should read --an--.

COLUMN 4
Line 36, "polyethylsulfure" should read --polyethylsulfone--; and "polyethylsul-" should read --polypropylene.--;
Line 37, "fone." should be deleted.

COLUMN 8
Line 46, "plate" should read --plate 4000--.

COLUMN 9
Line 5, "therebetween" should be deleted.

COLUMN 10
Line 44, "outlet" should read --projecting portion--.
Line 43, "projecting portion" should read --outer--.

COLUMN 11
Line 10, "It" should read --If--;
Line 11, "it" should read --it is--.

UNITED STATES PATENT AND TRADEMARK OFFICE

CERTIFICATE OF CORRECTION

PATENT NO. : 5,629,728

DATED : May 13, 1997

INVENTOR(S) : SEIICHIRO KARITA, ET AL.

It is certified that error appears in the above-identified patent and that said Letters Patent is hereby corrected as shown below:

COLUMN 13

Line 30, "mucleate" should read --nucleate--.

COLUMN 15

Line 1, "claim" should read --claim 1,--.

Signed and Sealed this

Twenty-third Day of December, 1997

Bruce Lehman

*Attest:*

BRUCE LEHMAN

*Attesting Officer*

*Commissioner of Patents and Trademarks*